US006012183A

United States Patent [19]

Brooke et al.

[11] Patent Number: 6,012,183

[45] Date of Patent: Jan. 11, 2000

[54] RESIDENT TRANSFER APPARATUS

[75] Inventors: Jason C. Brooke, Mt. Pleasant, S.C.; Guy Fragala, Northborough, Mass.

[73] Assignee: Hill-Rom, Inc., Batesville, Ind.

[21] Appl. No.: 09/084,023

[22] Filed: May 22, 1998

[51] Int. Cl.[7] ..... A61G 7/08

[52] U.S. Cl. ..... 5/81.1 HS; 5/81.1 C

[58] Field of Search ..... 5/81.1 R, 81.1 C, 5/81.1 HS, 81.1 IT, 703, 662

[56] References Cited

U.S. PATENT DOCUMENTS

| | | | |
|---|---|---|---|
| Re. 35,299 | 7/1996 | Weedling et al. . | |
| Re. 35,468 | 3/1997 | Newman . | |
| 3,593,351 | 7/1971 | Dove . | |
| 3,769,642 | 11/1973 | Warman . | |
| 3,829,914 | 8/1974 | Treat | 5/81.1 T |
| 3,940,808 | 3/1976 | Petrini . | |
| 4,051,565 | 10/1977 | Berge | 5/81.1 C |
| 4,125,907 | 11/1978 | Junginger et al. . | |
| 4,232,412 | 11/1980 | Petrini . | |
| 4,262,375 | 4/1981 | Lilienthal . | |
| 4,274,168 | 6/1981 | Depowski . | |
| 4,297,753 | 11/1981 | Langren . | |
| 4,327,453 | 5/1982 | Sefton . | |
| 4,504,988 | 3/1985 | Deutchman . | |
| 4,700,416 | 10/1987 | Johansson . | |
| 4,716,607 | 1/1988 | Johansson . | |
| 4,748,701 | 6/1988 | Marlowe et al. . | |
| 4,761,841 | 8/1988 | Larsen . | |
| 4,797,960 | 1/1989 | Vaiana et al. . | |
| 4,837,872 | 6/1989 | DiMatteo et al. . | |
| 4,839,933 | 6/1989 | Plewright et al. . | |
| 4,908,889 | 3/1990 | Lonardo | 5/81.1 T |
| 4,941,220 | 7/1990 | DiMatteo et al. . | |
| 4,970,738 | 11/1990 | Cole . | |
| 5,020,171 | 6/1991 | DiMatteo et al. . | |
| 5,036,557 | 8/1991 | Fales . | |
| 5,103,512 | 4/1992 | DiMatteo et al. . | |
| 5,148,558 | 9/1992 | Dunn | 5/81.1 T |
| 5,165,122 | 11/1992 | Phalen . | |
| 5,193,233 | 3/1993 | Miller . | |
| 5,271,110 | 12/1993 | Newman . | |
| 5,274,862 | 1/1994 | Palmer, Jr. et al. . | |
| 5,329,655 | 7/1994 | Garner . | |
| 5,359,739 | 11/1994 | Rains et al. . | |
| 5,375,280 | 12/1994 | O'Sullivan et al. | 5/662 |
| 5,396,669 | 3/1995 | Nieminen . | |
| 5,442,821 | 8/1995 | Weeks . | |
| 5,469,588 | 11/1995 | DiMatteo et al. . | |
| 5,530,974 | 7/1996 | Rains et al. . | |
| 5,642,537 | 7/1997 | Johnson . | |
| 5,737,781 | 4/1998 | Votel . | |
| 5,742,958 | 4/1998 | Solazzo . | |

FOREIGN PATENT DOCUMENTS

| | | |
|---|---|---|
| 169275 B1 | 10/1994 | Denmark . |

OTHER PUBLICATIONS

"Patient Transfer Systems", Evaluation brochure, 10 pages, date unknown.

"Study Ranks Slipp™—The Patient Mover Best for Reducing Back Stress", Informational Release, Inventive Products, Inc brochure, 3 pages, date unkown.

"Patient Transfer Products for Hospitals, Nursing Homes and Carers atHome", Scan Medical brochure, 8 pages, Nov., 1995.

*Primary Examiner*—Michael Trettel
*Attorney, Agent, or Firm*—Barnes & Thornburg

[57] ABSTRACT

An apparatus for transferring a resident from a first support surface to a second adjacent support surface comprising a sheet of material formed as a continuous loop having an inner surface configured to slide over itself as the continuous loop sheet of material is rotated and an outer surface configured to support the resident when the sheet of material is located between the resident and the first and second surfaces and a plurality of sets of handles attached to the looped material both longitudinally and width-wise of the looped material to provide a health care attendant a gripping mechanism to rotate the looped material when a patient rests thereon.

27 Claims, 3 Drawing Sheets

RESIDENT TRANSFER APPARATUS

BACKGROUND OF THE INVENTION

The present invention relates to a resident transfer apparatus to facilitate the transfer of less mobile and totally immobile residents from one support surface to another adjacent support surface.

Several devices exist for the purpose of transferring residents from a bed to a movable, rolling platform, for example. With these existing devices, however, the task of transferring a resident from the first support surface to the second often becomes cumbersome to the person responsible for transferring the resident due to the nature of the particular transfer device. For example, many resident transfer devices currently involve complex pulling and support mechanisms. Caregivers are often at risk of lifting related injuries during such transfers. Also, when using conventional resident transfer devices, it becomes difficult to transfer the resident from one surface to another evenly because the device itself causes the patient to shift sideways in a non-uniform manner during such a transfer. This may result in additional work for the caregiver or caregivers and additional discomfort for the resident being transferred.

What is needed is an apparatus for more easily and comfortably transferring a resident from one support surface to another while improving staff productivity by being quicker and easier to retrieve, use, and remove after use. The present invention provides a transfer device to transfer a resident from one support surface to another while minimizing movement of the resident toward a head end or foot end of the support surface during the transfer process. The present invention also provides a resident transfer device that is easier to use by a caregiver or caregivers and that is able to transfer a resident from one support surface to another more efficiently.

According to one aspect of the present invention, an apparatus is provided for transferring a resident from a first support surface to a second, adjacent support surface. The apparatus includes a sheet of material having an inner surface configured to be folded over itself and an outer surface configured to abut the resident when the sheet of material is located between the resident and the first and second support surfaces. The apparatus also includes a plurality of spaced apart handles coupled to the sheet of material and located on the outer surface to facilitate a caregiver with moving the sheet of material over itself in a direction toward the second support surface to transfer the resident from the first support surface to the second support surface.

In the illustrated embodiment, the handles are spaced apart along a width of the sheet of material in a direction parallel to the direction of transfer of the resident. The illustrated embodiment includes at least two sets of handles located on the outer surface of the sheet of material. The handles of each set are spaced apart along a width of the sheet of material in a direction parallel to the direction of transfer of the resident so that at least one handle in each set of handles is accessible to the caregiver as the sheet of material is moved toward the second support surface. Illustratively, the plurality of handles includes two sets of inner handles, two sets of outer handles, and a center set of handles located between the two sets of inner handles. Each set of handles is spaced apart along a length of the sheet of material.

In one embodiment, the inner surface has a lower coefficient of friction than a coefficient of friction of the outer surface. The sheet of material may be formed from a single sheet or from an inner sheet of material coupled to an outer sheet of material. The inner surface is configured to facilitate sliding movement of the inner surface over itself in a direction of transfer of the resident. The inner surface is also configured to resist movement in a direction normal to the direction of transfer as the inner surface slides over itself.

According to another aspect of the present invention, an apparatus is provided for transferring a resident from a first support surface to a second, adjacent support surface. The apparatus includes a sheet of material formed as a continuous loop having an inner surface configured to slide over itself as the continuous loop sheet of material is rotated and an outer surface configured to abut the resident when the sheet of material is located between the resident and the first and second support surfaces. The apparatus also includes at least one strip of material configured to extend around an outer periphery of the continuous loop sheet of material. The at least one strip of material being coupled to the sheet of material at spaced apart locations so that uncoupled portions of the strip provide a plurality of handles spaced apart around the outer periphery of the continuous loop sheet of material.

In the illustrated embodiment, two inner strips of material are coupled to the sheet of material to form two inner sets of handles and two outer strips of material are coupled to the sheet of material to form two outer sets of handles. The two inner strips and the outer two strips are spaced apart along a length of the sheet of material. One illustrated embodiment also includes a center strip of material located between the two inner strips of material. The center strip of material is coupled to the sheet of material to provide a center set of handles which are spaced apart around the outer periphery of the continuous loop sheet of material.

Additional features and advantages of the present invention will become apparent upon consideration of the following description of illustrative embodiments exemplifying the best mode of carrying out the invention as presently perceived.

DETAILED DESCRIPTION OF THE DRAWINGS

Figure 1:
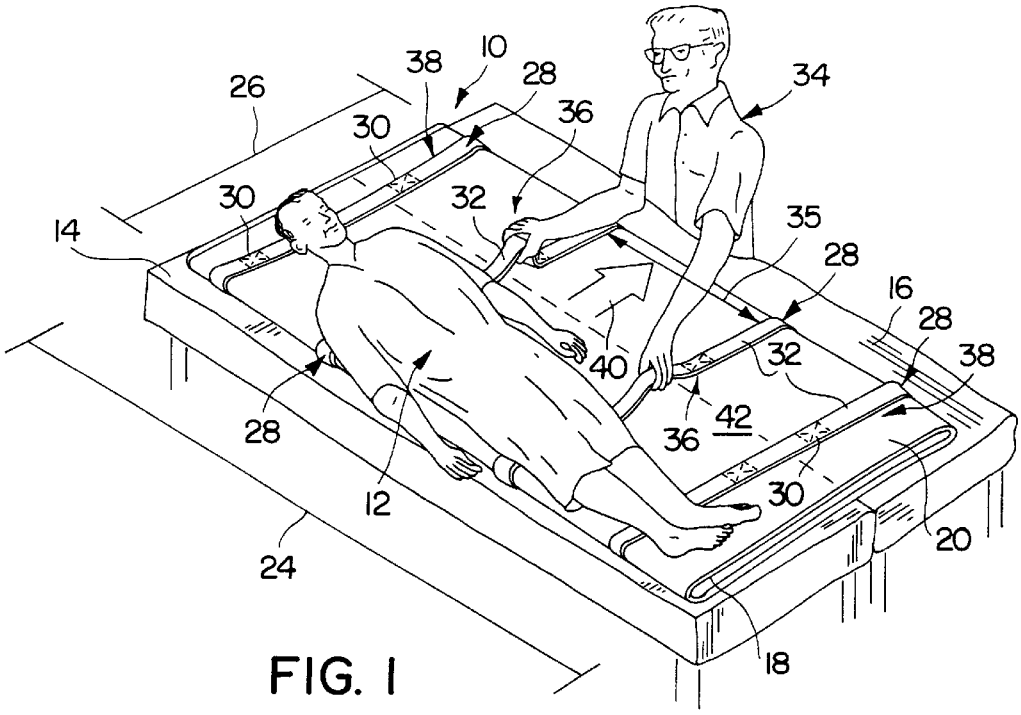
FIG. 1 is a perspective view of a resident transfer apparatus located on two adjacent support surfaces with a resident located on a portion of the resident transfer device above a first support surface and illustrating a caregiver beginning the process of using the resident transfer device to transfer the resident from the first support surface to a second support surface located adjacent the first support surface and nearer the caregiver.

In accordance with the present invention, a resident transfer device 10 is provided to be used to transfer a resident 12 from a first support surface 14 to a second, adjacent support surface 16. The resident transfer device 10 includes a sheet of material 22 having an inner surface 18 and an outer surface 20. The resident 12, when being transferred from the first support surface 14 to the second support surface 16, is positioned on the outer surface 20 of the resident transfer device 10. The resident transfer device 10 is illustratively formed as a continuous loop of material 22. The resident transfer device 10 has a length 24 and a width 26. The resident 12 is positioned to lie along the length 24 of the transfer device 10. Illustratively, length dimension 24 is about 71 inches and the width dimension 26 is about 42 inches.

As shown in FIGS. 1–4, pull straps 28 are spaced apart along the length 24 of the resident transfer device 10. The straps 28 are illustratively strips of material attached to the sheet of material 22 at spaced apart locations along the width 26 of the resident transfer device 10. Pull straps 28 extend in a direction parallel to a direction of transfer of the resident 12.

The pull straps 28 are illustratively each a continuous loop of material securely attached to the material 22 of the resident transfer device 10 by multiple, spaced apart stitches 30. The pull straps 28 are attached so that the stitches 30 are each approximately two to three inches long and are spaced apart around the continuous loop of material 22. These spaced apart stitches 30 provide each pull strap 28 with open gap areas or handles 32 approximately five to six inches long where the pull strap 28 is not attached to the outer surface 20 of the resident transfer device 10. A plurality of pull handles 32 are thereby provided for a caregiver 34 to grip during a transfer operation. The pull handles 32 of each strap 28 are located on the outer surface 20 at spaced apart locations along the width 26 of the sheet of material 22 so that at least one handle 32 is always accessible to the caregiver 34 as the sheet of material 22 is rotated. It is understood that separate pull handles may be attached to the outer surface 20 of material 22, if desired.

The pull straps 28 and handles 32 are located such that a distance 35 between an inner pair of straps 36 is small enough so that a medium sized caregiver 34 is able to pull a medium sized resident 12 between first and second support surfaces 14, 16 as a one caregiver transfer. Two outer straps 38 are located to accommodate two caregivers 34 pulling the handles 32 to move the resident 12. In the two person transfer, each caregiver 34 uses one inner strap 36 and one outer strap 38. The pull straps 28 are illustratively thick enough to enable the caregiver 34 to grip the pull handles 32 comfortably and reduce the risk of capillary closure of the fingers during the transfer process. The pull straps 28, however, are also thin enough so that they are not perceived as noticeable bumps by the resident 12 when lying on the transfer device 10. The continuous pull straps 28 ensure that there is always a grasping point or handle 32 within easy reach of the caregiver 34, thus minimizing the need for the caregiver 34 to lean over while pulling the resident 12.

Figure 2:
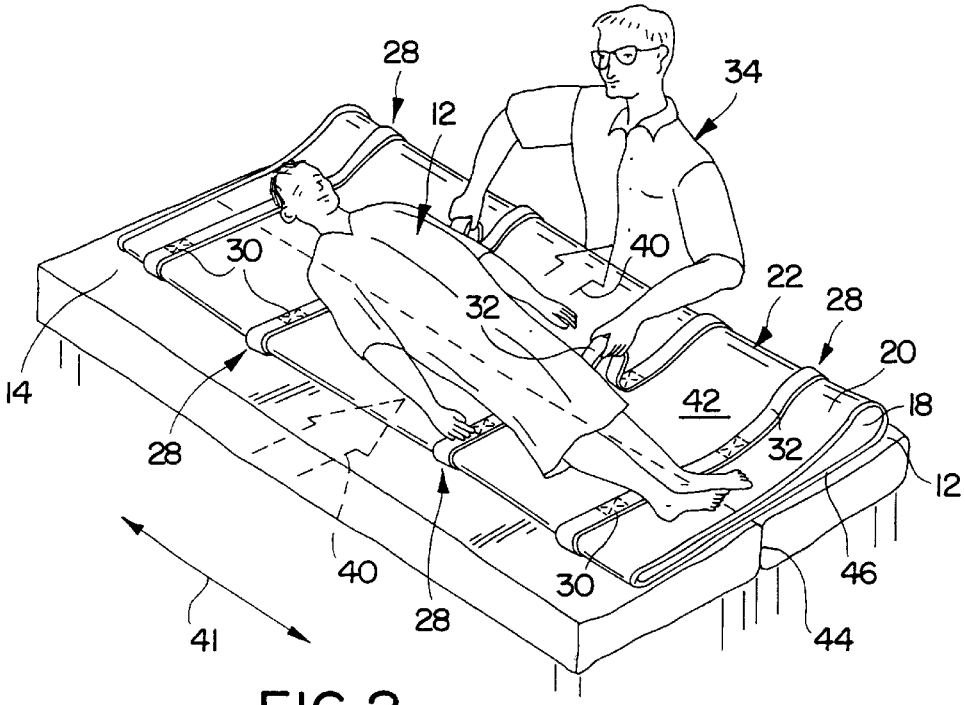
FIG. 2 is a perspective view illustrating the resident located on the resident transfer device and in the process of being transferred by the caregiver from the first support surface to the second support surface.

The inside surface 18 of the resident transfer device 10 slides easily against itself across the width 26 of the transfer device 10 in the direction of arrow 40 and resists sliding against itself along the length 24 of the transfer device 10 as illustrated by double headed arrow 41 in FIG. 2. This works to reduce lengthwise movement of the resident 12 toward a head end or foot end of the support surface 16 during transfer. The desired fabric properties minimizing the coefficient of friction of the resident transfer device 10 can be achieved through various types of yarns, weaves, coatings, dippings, or other processes applied to the material 22. Calendered nylon is one example of a material which could be used for material 22 of the resident transfer device 10. Calendered nylon, along with the other previously mentioned materials, slips easily in the direction of rotation. The nylon material resists movement in the directions of arrow 41 that is generally perpendicular to the direction of transfer illustrated by arrow 40. Other woven materials may also be used for material 22 of the transfer device 10. The outside surface 20 of the resident transfer device 10 does not need to be as smooth or slick as the inside surface 18. A rougher surface would, in fact, deter the resident 12 from slipping on the outside surface 20 of the transfer device 10 during the transfer process. It is understood that separate sheets of material may be coupled together and used to form the inner surface 18 having a low coefficient of friction and the outer surface 20 having a higher coefficient of friction, if desired.

Prior to transferring the resident 12, the resident transfer device 10 is positioned on the first and second support surfaces 14, 16 so that the majority of the transfer device 10 is located on the first support surface 16 under the resident 12 while a portion of the transfer device 10 is located on the second support surface 18. See FIG. 1. In FIG. 1, a first portion 42 of the outer surface 20 of the resident transfer device 10 faces upwardly and a second portion 46 faces downwardly toward the support surfaces 14, 16. The resident 12 to be transferred is situated on the resident transfer device 10 above the first support surface 14. The resident 12 is typically rolled to one side to slide the transfer device 10 under the resident 12. To transfer the resident 12 from the first to the second support surface 14, 16, as shown in FIGS. 1–4, the caregiver 34 begins by standing near second support surface 16.

At the start of the transfer process, as illustrated in FIG. 1, the caregiver 34 grasps pull handles 32 of straps 28 located on the upwardly facing portion 42 of the transfer device 10. If the transfer is to be conducted by one caregiver 34 only, the inner pair of straps 36 are more easily used to transfer the resident 12, however, any combination of one or more pull straps 28 may be used. If two caregivers 34 are needed to transfer the resident 12, then each caregiver 34 may grasp one inner strap 36 and one outer strap 38 in order to transfer the resident 12. The caregiver 34 then pulls on pull handles 32 in the direction of arrow 40 that the sheet of material 22 rotates and the resident 12 is to be transferred as shown, for example, in FIG. 1.

Figure 3:
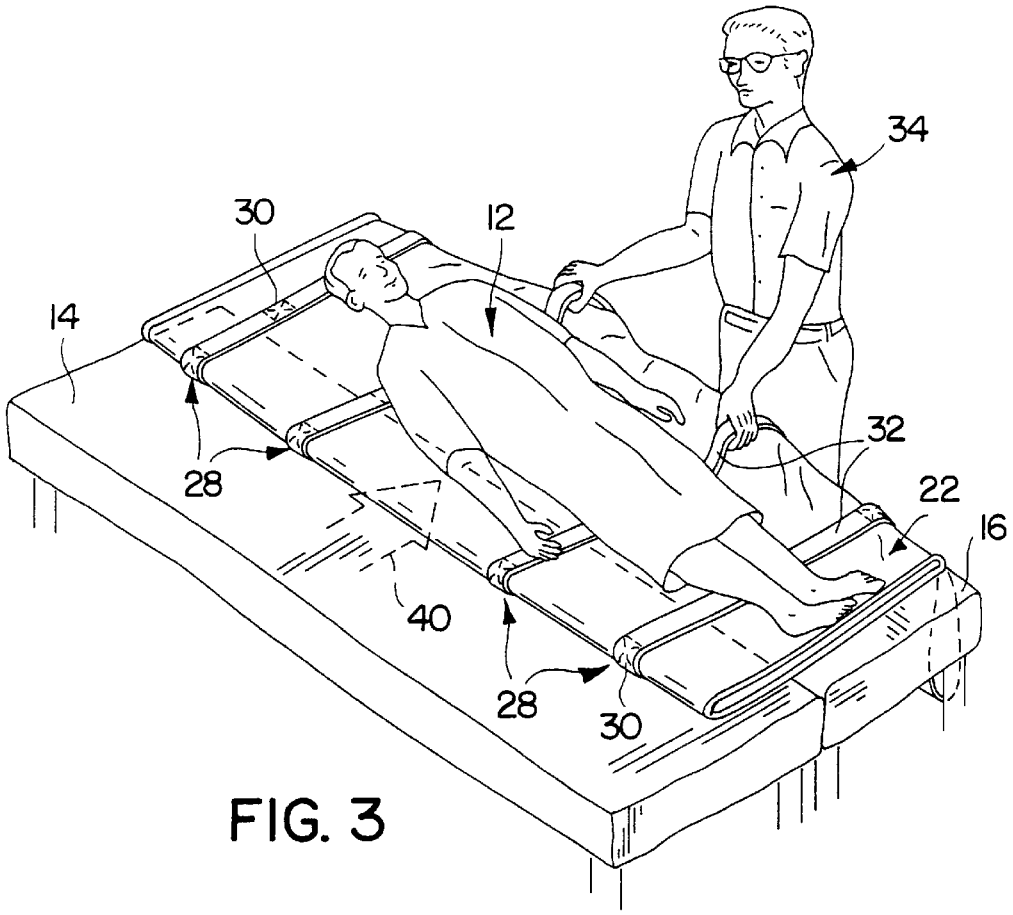
FIG. 3 is a perspective view illustrating the resident still located on the resident transfer device and almost completely transferred from the first support surface to the second support surface.
Figure 4:
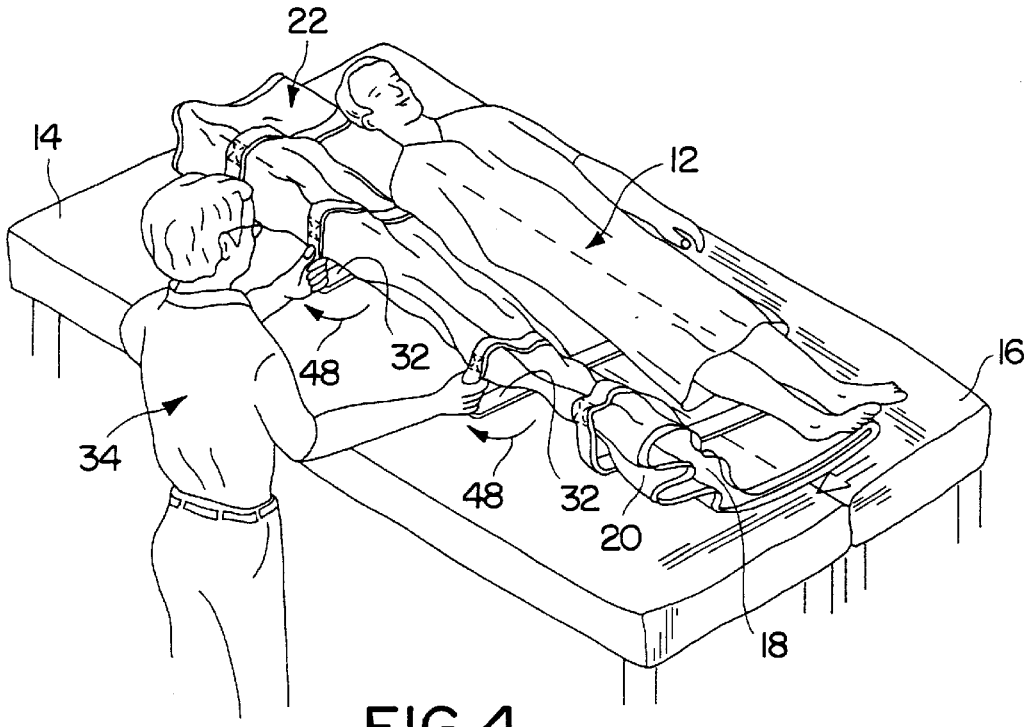
FIG. 4 is a perspective view illustrating the resident successfully positioned on the second support surface, with the caregiver located near the first support surface opposite from the resident, and illustrating the caregiver removing the resident transfer device from beneath the resident.

During the transfer process, the transfer device 10 moves in a continuous rolling motion folding upon itself as shown in FIGS. 1–4. The material 22 of the transfer device 10 provides enough rigidity or stiffness so that during the transfer process a transfer surface is maintained between the surfaces 14, 16 to reduce the likelihood that bodily appendages of the resident 12 will fall into a narrow gap 44 existing between the first and second support surfaces 14, 16. As the resident transfer device 10 folds upon itself, the resident 12 is moved closer to the second support surface 16. Initial movement of the resident 12 in the direction of arrow 40 is illustrated in FIG. 2. The contact area between the transfer device 10 and the resident 12 does not change during the transfer process. Once resident 12 has been completely transferred from the first support surface 14 to the second support surface 16, as illustrated in FIG. 3, the resident 12 still remains on the resident transfer device 10 while a portion of the transfer device 10 is located over the first support surface 14.

To remove the resident transfer device 10 from beneath the resident 12, caregiver 34 moves to the opposite side of the resident 12 near the first support surface 14. See FIG. 4. Also, first support surface 14 may be moved away from the second support surface 16. Caregiver 34 then grasps the pull handles 32 on the downwardly facing surface 46 of the transfer device 10 and pulls on pull handles 32 in a direction away from the patient as illustrated by arrows 48 in FIG. 4. By doing this, the resident transfer device 10 slides easily from beneath resident 12 without the need to lift the resident 12. This minimizes the discomfort of resident 12. Caregiver 34 may also remove resident transfer device 10 by remaining near second support surface 16 and simply reaching over the resident 12 and performing the steps described above.

Figure 5:
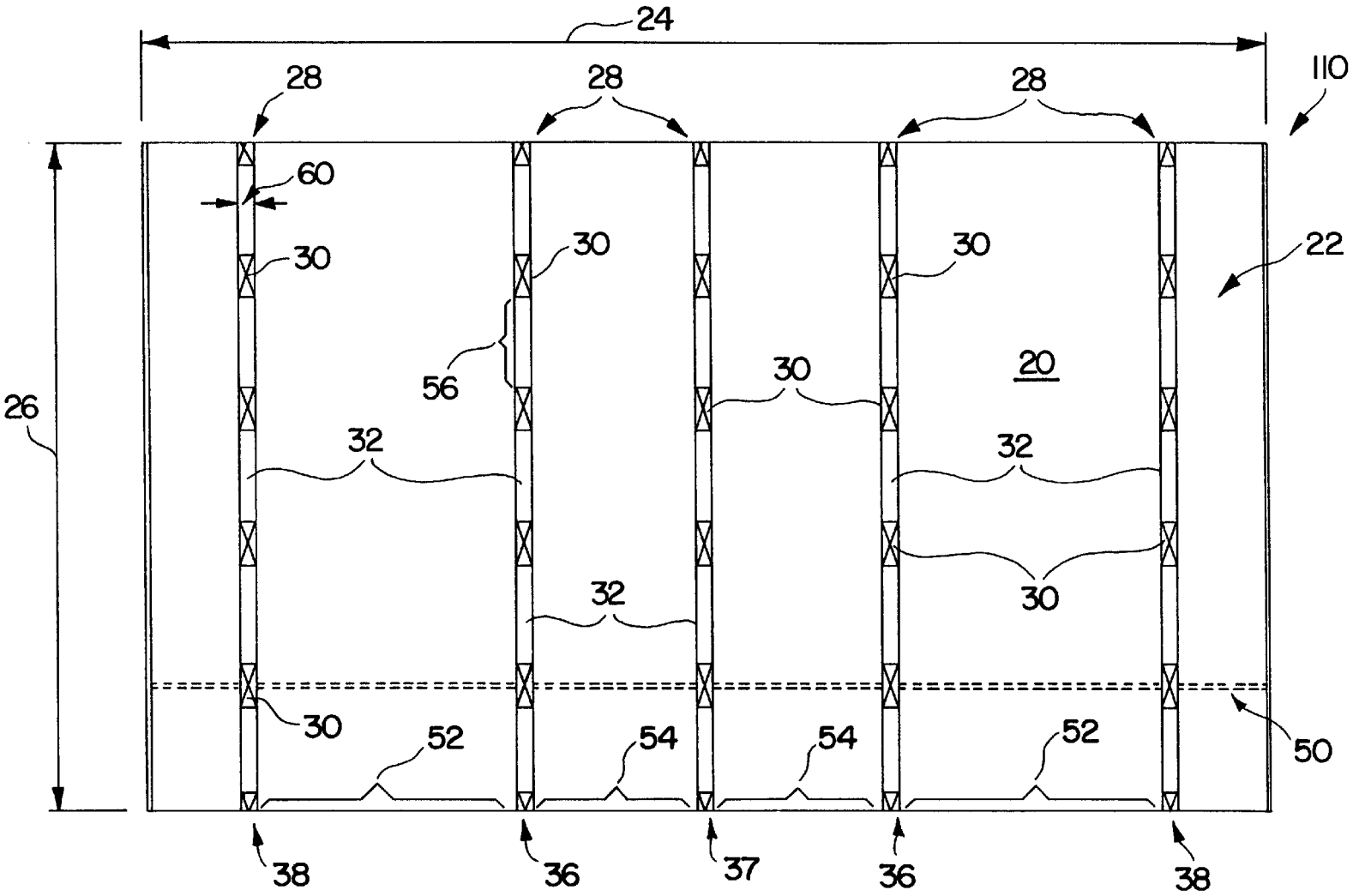
FIG. 5 is a top view of another embodiment of the resident transfer device illustrating the placement of the pull straps around the width of the device to facilitate transfer of the patient.

FIG. 5 shows another illustrated embodiment of the present invention. The embodiment shown in FIG. 5 is nearly identical to resident transfer device 10 shown in FIGS. 1–4. All identical reference numbers of transfer device 110 used to describe the transfer device 10 perform the same or similar functions. In the FIG. 5 embodiment, transfer device 110 includes five pull straps 28 rather than four as illustrated in FIGS. 1–4. The fifth, or center pull strap 37 is located centrally between the inner pair of pull straps 36. This center pull strap 37 serves the purpose of giving the caregiver 34 another, easily accessible area to grasp and pull the transfer device 110 if needed. More specifically, center pull strap 37 is typically used when removing transfer device 110 from beneath resident 12 due to the placement of the pull strap 37 substantially beneath a location of the center of gravity of the resident 12.

Resident transfer device 110 is similarly a continuous loop of material 22 sewn together. As illustrated in FIG. 5, transfer device 110 is sewn along dotted line 50. Illustratively, pull straps 28 of resident transfer device 110 have a width 60 of approximately one inch. The dimension 56 of the open gap area or pull handles 32 of pull straps 28 is about 5 to about 6 inches whereas the dimension 58 of the stitched portions 30 is about 2 to about 3 inches. In addition, the distance 52 between the outer pair of pull straps 38 and the inner pair of pull straps 36 is about 16 to about 17 inches and the distance 54 between the inner pair of pull straps 36 and the center pull strap 37 is about 10 to about 11 inches.

For both resident transfer devices 10, 110 material 22 is easily cleanable. Material 22 provides flexibility to include folding, rolling, or hanging so that resident transfer devices 10, 110 are easily stored. This flexibility also ensures more comfort for the resident 14 during the transfer process. Resident transfer devices 10, 110 are illustratively made in one size to accommodate most any size resident 12 needing to be transferred. It is understood that the length and width dimensions 24 and 26 may be any desired dimensions depending upon the particular transfer procedures and resident sizes.

Although many other dimensions are given and shown in the illustrated embodiments, it is within the scope of the invention to include any such dimensions as desired while still maintaining a usable transfer device. It is also understood that although a continuous loop of material is illustrated, a sheet of material folded over itself may be used in accordance with certain aspects of the present invention.

Although the invention has been described in detail, variations and modifications exist within the scope and spirit of the invention as described and defined in the following claims.

What is claimed is:

1. An apparatus for transferring a resident from a first support surface to a second, adjacent support surface, the apparatus comprising:

a sheet of material forming a continuous loop and having an inner surface configured to extend over itself and an outer surface configured to abut the resident when the sheet of material is located between the resident and the first and second support surfaces; and a plurality of handles coupled to the sheet of material at spaced apart locations around the periphery of the loop to facilitate a caregiver with moving the sheet of material over itself to transfer the resident from the first support surface to the second support surface.

2. The apparatus of claim 1, wherein the handles are spaced apart along a width of the sheet of material in a direction parallel to the direction of transfer of the resident.

3. The apparatus of claim 1, wherein the plurality of handles includes at least two sets of handles located on the outer surface of the sheet of material, the handles in each set of handles being spaced apart along a width of the sheet of material in a direction parallel to the direction of transfer of the resident so that at least one handle in each set of handles is accessible to the caregiver as the sheet of material is moved toward the second support surface.

4. The apparatus of claim 3, wherein the plurality of handles includes two sets of inner handles and two sets of outer handles, each set of handles being spaced apart along a length of the sheet of material.

5. The apparatus of claim 4, further comprising a center set of handles located between the two sets of inner handles.

6. The apparatus of claim 1, wherein the plurality of handles is formed by a strip of material extending around an outer periphery of the continuous loop sheet of material, the strip of material being coupled to the sheet of material at spaced apart locations so that uncoupled portions of the strip provide the spaced apart handles.

7. The apparatus of claim 6, wherein the handles have a length of about five to about six inches.

8. The apparatus of claim 1, wherein the sheet of material is a woven material.

9. The apparatus of claim 1, wherein the sheet of material is a calendared nylon material.

10. The apparatus of claim 1, wherein the inner surface has a lower coefficient of friction than a coefficient of friction of the outer surface.

11. The apparatus of claim 10, wherein the sheet of material includes an inner sheet of material coupled to an outer sheet of material.

12. The apparatus of claim 1, wherein the inner surface is configured to facilitate sliding movement of the inner surface over itself in a direction of transfer of the resident, the inner surface being configured to resist movement in a direction normal to the direction of transfer as the inner surface slides over itself.

13. The apparatus of claim 1, wherein the plurality of handles is formed by a strip of material extending across the sheet of material, the strip of material being coupled to the sheet of material at spaced apart locations so that uncoupled portions of the strip provide the spaced apart handles.

14. An apparatus for transferring a resident from a first support surface to a second, adjacent support surface, the apparatus comprising:

a sheet of material formed as a continuous loop having an inner surface configured to slide over itself as the continuous loop sheet of material is rotated and an outer surface configured to abut the resident when the sheet of material is located between the resident and the first and second support surfaces; and at least one strip of material configured to extend around an outer periphery of the continuous loop sheet of material, the at least one strip of material being coupled to the sheet of material at spaced apart locations so that uncoupled portions of the strip provide a plurality of handles spaced apart around the outer periphery of the continuous loop sheet of material.

15. The apparatus of claim 19, wherein two inner strips of material are coupled to the sheet of material to form two inner sets of handles and two outer strips of material are coupled to the sheet of material to form two outer sets of handles, the two inner strips and the outer two strips being spaced apart along a length of the sheet of material.

16. The apparatus of claim 15, further comprising a center strip of material located between the two inner strips of material, the center strip of material being coupled to the sheet of material to provide a center set of handles spaced apart around the outer periphery of the continuous loop sheet of material.

17. The apparatus of claim 14, wherein the handles have a length of about five to about six inches.

18. The apparatus of claim 14, wherein the sheet of material is a woven material.

19. The apparatus of claim 14, wherein the sheet of material is a calendared nylon material.

20. The apparatus of claim 14, wherein the inner surface has a lower coefficient of friction than a coefficient of friction of the outer surface.

21. The apparatus of claim 20, wherein the sheet of material includes an inner sheet of material coupled to an outer sheet of material.

22. The apparatus of claim 14, wherein the inner surface is configured to facilitate sliding movement of the inner surface over itself in a direction of transfer of the resident, the inner surface being configured to resist movement in a direction normal to the direction of transfer as the inner surface slides over itself.

23. An apparatus for transferring a resident from a first support surface to a second, adjacent support surface, the apparatus comprising:

a sheet of material having an inner surface configured to be folded over itself and an outer surface configured to abut the resident when the sheet of material is located between the resident and the first and second support surfaces;

a plurality of spaced apart handles coupled to the sheet of material and located on the outer surface to facilitate a caregiver with moving the sheet of material over itself in a direction toward the second support surface to transfer the resident from the first support surface to the second support surface;

wherein the plurality of handles includes at least two sets of handles located on the outer surface of the sheet of material, the handles in each set of handles being spaced apart along a width of the sheet of material in a direction parallel to the direction of transfer of the resident so that at least one handle in each set of handles is accessible to the caregiver as the sheet of material is moved toward the second support surface; and wherein the plurality of handles includes two sets of inner handles and two sets of outer handles, each set of handles being spaced apart along a length of the sheet of material.

24. The apparatus of claim 23, further comprising a center set of handles located between the two sets of inner handles.

25. An apparatus for transferring a resident from a first support surface to a second, adjacent support surface, the apparatus comprising:

a sheet of material formed as a loop and having an inner surface configured to be folded over itself and an outer surface configured to abut the resident when the sheet of material is located between the resident and the first and second support surfaces;

a plurality of spaced apart handles coupled to the sheet of material and located on the outer surface to facilitate a caregiver with moving the sheet of material over itself in a direction toward the second support surface to transfer the resident from the first support surface to the second support surface; and wherein the plurality of handles is formed by a strip of material extending around an outer periphery of the continuous loop sheet of material, the strip of material being coupled to the sheet of material at spaced apart locations so that uncoupled portions of the strip provide the spaced apart handles.

26. The apparatus of claim 25, wherein the handles have a length of about five to about six inches.

27. An apparatus for transferring a resident from a first support surface to a second, adjacent support surface, the apparatus comprising:

a sheet of material having an inner surface configured to be folded over itself and an outer surface configured to abut the resident when the sheet of material is located between the resident and the first and second support surfaces;

a plurality of spaced apart handles coupled to the sheet of material and located on the outer surface to facilitate a caregiver with moving the sheet of material over itself in a direction toward the second support surface to transfer the resident from the first support surface to the second support surface; and wherein the plurality of handles is formed by a strip of material extending across the sheet of material, the strip of material being coupled to the sheet of material at spaced apart locations so that uncoupled portions of the strip provide the spaced apart handles.

* * * * *